US006256010B1

(12) United States Patent
Chen et al.

(10) Patent No.: US 6,256,010 B1
(45) Date of Patent: Jul. 3, 2001

(54) DYNAMIC CORRECTION OF LCD GAMMA CURVE

(75) Inventors: Yen-Chen Chen; Chien-Ho Lin; Chih-Wei Wang, all of Hsinchu (TW)

(73) Assignee: Industrial Technology Research Institute, Hsin Chu (TW)

( * ) Notice: Subject to any disclaimer, the term of this patent is extended or adjusted under 35 U.S.C. 154(b) by 0 days.

(21) Appl. No.: 08/885,761

(22) Filed: Jun. 30, 1997

(51) Int. Cl.[7] ..... G09G 5/10; G09G 3/36
(52) U.S. Cl. ..... 345/147; 345/88; 345/89
(58) Field of Search ..... 345/147, 89, 88; 348/679, 674, 163; 382/167; 341/138

(56) References Cited

U.S. PATENT DOCUMENTS 5,461,430 10/1995 Hagerman .
5,496,106 * 3/1996 Anderson ..... 348/679
5,585,841 * 12/1996 Hardin ..... 348/163
5,724,036 * 3/1998 Kobayashi et al. ..... 341/138
5,754,150 * 5/1998 Matsui ..... 345/89
5,764,216 * 6/1998 Tanaka et al. ..... 345/147
5,793,885 * 8/1998 Kasson ..... 382/167
5,847,688 * 12/1998 Ohi et al. ..... 345/89

* cited by examiner

*Primary Examiner*—Steven Saras
*Assistant Examiner*—Alecia D. Nelson
(74) *Attorney, Agent, or Firm*—Tung & Associates

(57) ABSTRACT

A method and means for correcting the γ - curve of an LCD by calculating an inverse γ - curve from the γ - curve of the LCD measured by the manufacturer and producing a straight line V-T plot from the combination, a set of corrected voltages selected from the inverse γ - curve is provided for the different positions or viewing angles of the display, thus improving the γ - curve correction efficiency at different viewing angles of the LCD. In one embodiment, a timing control ASIC, that produces the horizontal scan and vertical scan signals of the display, is used to time the outputting of sets of γ - curve correction voltage signals stored in high speed memories for application, after digital to analog conversion, to the horizontal scan lines of the LCD to be corrected. The ASIC also provides a set of latch enable signals to a set of data latches, which receive the correction voltage signals as input signals from the memories, and provide the corrected voltage outputs, through a set of digital to analog converters (DACs) to a number of output lines connected to the LCD.

12 Claims, 4 Drawing Sheets

DYNAMIC CORRECTION OF LCD GAMMA CURVE

FIELD OF THE INVENTION

The present invention generally relates to liquid crystal displays and more particularly to a method and means for dynamically correcting the LCD γ - curve of such a display.

BACKGROUND OF THE INVENTION

Light transmission through a liquid crystal display (LCD) is non-linear when viewed from a central position with respect to the plane of the display. For example, as illustrated in FIG. 1, an LCD screen for a portable computer or a projection TV will normally have better transmittance and color rendition near the center of the display when viewed head-on than at the upper and lower edges, since the viewing angle is somewhat different for each scan line from top to bottom on the screen when viewed directly at an angle of 0° with the center line. The transmittance is a function of the applied voltage and is defined in the art by a V-T or γ - curve. As the transmittance is variable with the angle Θ at which a scan line of the display is viewed, a different light transmittance or γ - curve exists for each different viewing angle of the display, i.e., a curve exists for head-on viewing at 0°, for upward viewing at +10°, and when viewing downward at −10°, as shown in FIG. 2. As a practical matter, one γ - curve is selected for correcting purposes, and in the conventional method for correcting the γ - curve of an LCD, the correction curve at 0° is used and is typically applied by means of a voltage divider resistance network such that the correction curve is fixed. Consequently, the best γ - curve correction is typically not obtained, and poor color resolution results, in view of the fact that the head and tail of the curve are not straight so that the darkest and whitest spots cannot be seen.

Other attempts to deal with the problem of poor resolution at the edges have focused on the liquid crystal materials and the changing of their characteristics. There is normally a significant difference in the transmittance characteristics of the three LCD scan lines at −10°, 0°, and +10° viewing angle so that corrective approaches try to change their characteristics to cause overlap. This approach has been found to be very difficult to accomplish so that a satisfactory solution has not been found.

Another approach is directed to modifying the control circuitry for applying voltages to the LCD. One example of a prior art disclosure dealing with circuitry for gamma correction is found in U.S. Pat. No. 5,461,430 to J. G. Hagerman wherein a gamma correction circuit is directed to correcting the grey scale linearity of images displayed on a liquid crystal light valve and cathode ray tube combination using a plurality of amplifiers, each adapted to implement a predetermined transfer function, and configured to compensate for nonlinearity in the display. The gamma correction here is used in conjunction with dynamic threshold correction and involves the inclusion of current sources with the amplifiers.

It will therefore be seen from a consideration of the prior art that various approaches have been used to deal with the problem in the art of achieving a method and means that will improve γ - curve correction in LCDs so as to achieve optimum transmittance and color resolution to a viewer over the face of the display.

It is accordingly an object of the present invention to provide a method and means for improving γ - curve correction in LCDs whereby the transmittance and color resolution are optimized over the face of the display screen for a viewer observing the screen head on.

It is a further object of the present invention to provide a method and means for improving γ - curve correction in LCDs using a non-material approach wherein correction is achieved by calculating a suitable correction curve and implementing its application with appropriate circuitry.

SUMMARY OF THE INVENTION

In accordance with the present invention, a method and means are presented for correcting the γ - curve of an LCD by calculating an inverse γ - curve from the γ - curve of the LCD measured by the manufacturer and producing a straight line V-T correction curve from the combination, the straight line is then compared to an ideal V-T curve and its errors from the ideal curve is calculated. If the errors are acceptable, the inverse γ - curve is used to provide the set of corrected voltages for the different positions or viewing angles of the display. More specifically, the γ - curve correction voltages at different viewing angles are determined for the horizontal scan lines of the LCD, using the measured values appropriately modified by the straight line curve, and stored in memory. These different stored γ - curve correction voltages are then used to produce correct voltage values for creating light transmission at the different angles. The invention thus improves the γ - curve correction efficiency at different viewing angles of the LCD. The horizontal scan and vertical scan signals of the display are used as references in "dynamically" controlling the timing of the outputting of the sets of corrected voltage values stored in memory for conversion from digital to analog form and application to the horizontal scan lines of the display.

In one embodiment, a timing control application specific integrated circuit (ASIC), with clock, Hsync, and Vsynch inputs, is used to time the outputting of the sets of γ - curve correction voltage signals stored in high speed memories for application, after digital to analog conversion, to the horizontal scan lines of the LCD to be corrected. The ASIC also provides a set of latch enable signals to a set of data latches, which receive the correction voltage signals as input signals from the memories, and provide the corrected voltage outputs, through a set of digital to analog converters (DACs) to a number of output lines connected to the LCD.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENTS

Figure 1:
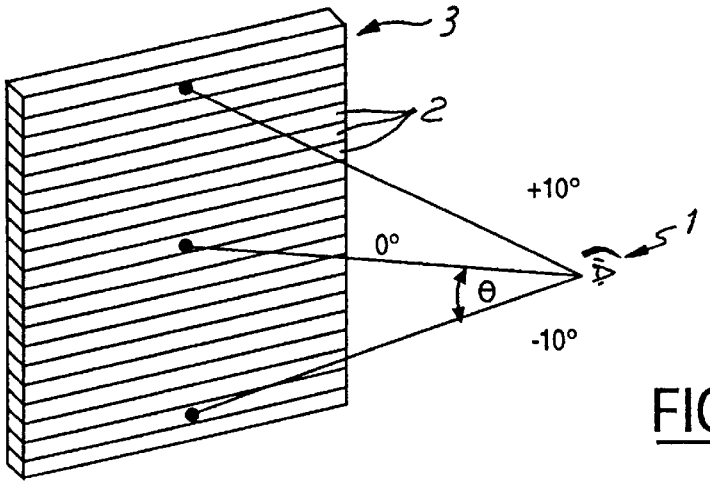
FIG. 1 shows the eye of a viewer with respect to an LCD screen of a portable computer and illustrates that the viewing angle Θ is somewhat different for each scan line from top to bottom on the screen when viewed directly at an angle of Θ=0° with the center line of the screen, and at Θ=+10° and −10°.
Figure 2:
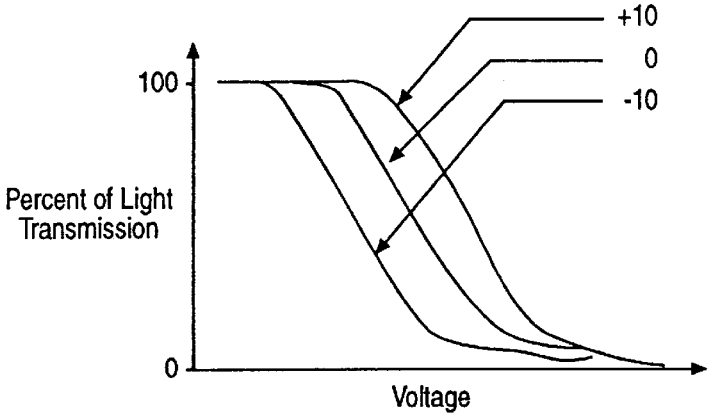
FIG. 2 is an illustration of the light transmittance vs. applied voltage values (V-T) or γ - curves for different viewing angles, i.e., Θ=−10°, 0°, and +10°, of an LCD screen.

The present invention involves a method and means for correcting the γ - curve for an LCD by delivering a set of corrected reference voltages for the different positions or viewing angles of the display to produce a uniform appearance on the LCD screen. Referring to FIG. 1, it will be seen that a viewer 1 observing the scan lines 2 on an LCD screen or panel 3 will view each line at a different angle Θ. The γ - curve for each scan line will differ at each different angle. A plot of the percentage of light transmittance vs. applied voltage for an LCD is shown in the form of V-T or γ - curves for three different viewing angles, i.e., −10°, 0°, and +10°, with respect to the face of the display in FIG. 2. Since a different light transmittance curve exists for each different viewing angle, and the conventional correction technique uses only the correction curve at 0°, that approach cannot achieve maximum correction as the display will have increasing uncorrected transmission under oblique viewing at top and bottom.

Figure 3:
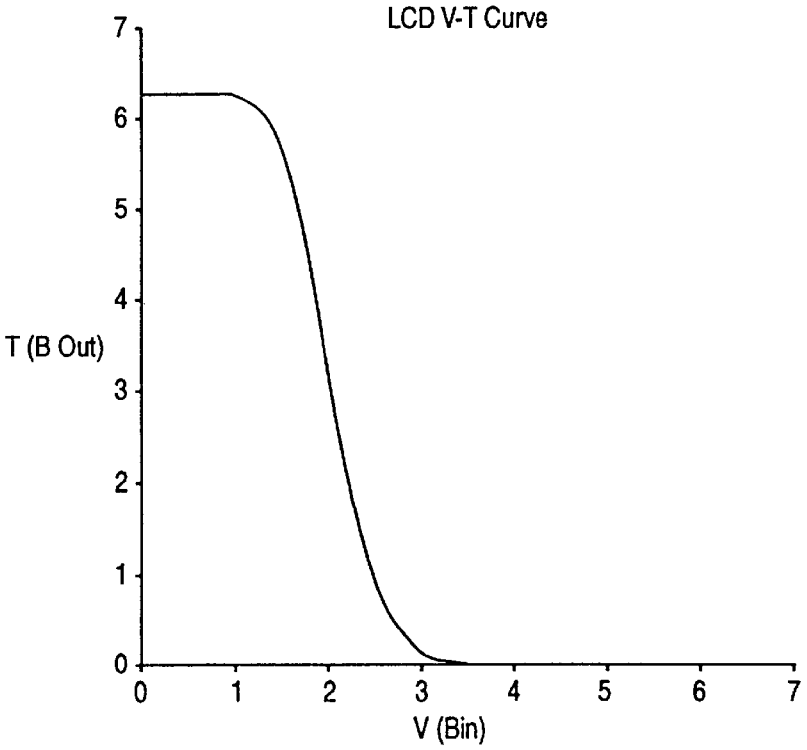
FIG. 3 illustrates a general example of a measured V-T curve based on a viewing angle of Θ as provided for a given LCD panel by the panel manufacturer.
Figure 4:
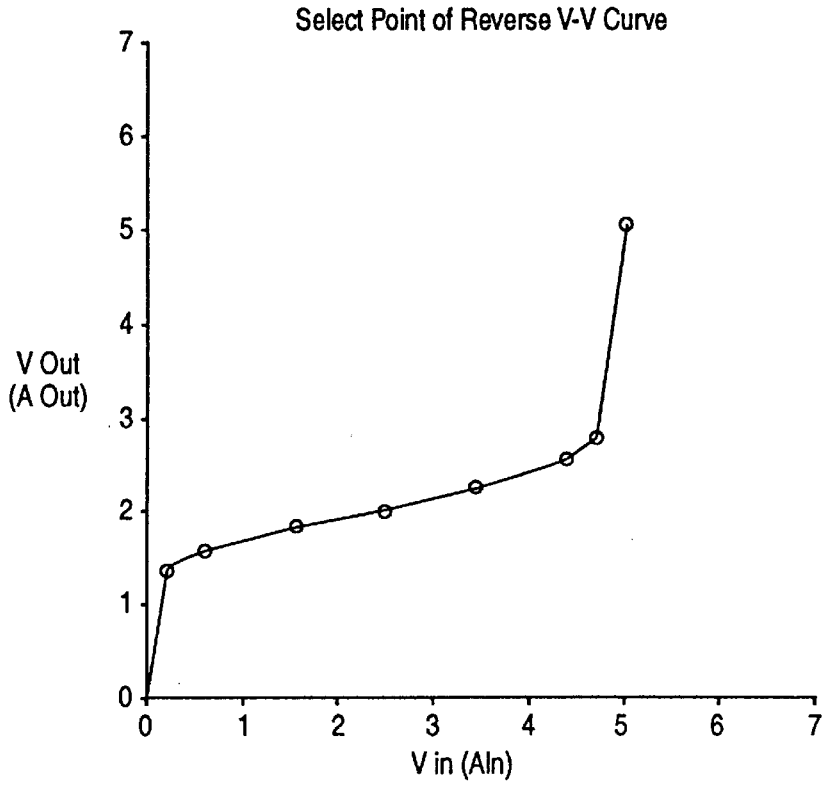
FIG. 4 illustrates an example of a V-V correction curve or inverse γ - curve that when combined with the measured γ - curve of FIG. 3 results in a substantially straight line correction curve.
Figure 5:
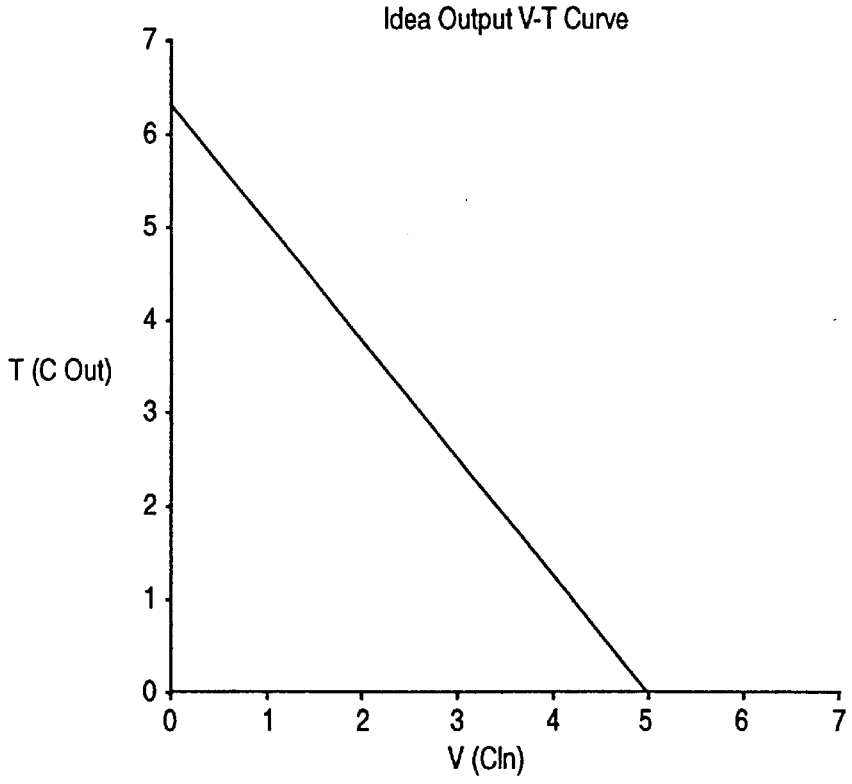
FIG. 5 illustrates an example of a substantially straight line correction curve resulting from the combination of the curves of FIGS. 3 and 4.

Presently, manufacturers of LCD panels measure the γ - curve data at each different angle and provide this information for each panel. A general example of such a V-T curve based on a viewing angle of Θ is shown in FIG. 3. It will be seen that the head and tail of the curve are not straight so that the darkest and whitest spots cannot be seen. In accordance with the invention, this γ - curve data is used to produce an inverse γ - curve that is combined with the data to provide a substantially straight line. More particularly, the manufacturer's V-T curve is evaluated and a number of points are selected to be used for creating the inverse γ - curve. For example, as shown in FIG. 3, nine points may be selected in the linear section of the curve at equal intervals on the horizontal axis of V ($B_{in}$) to produce a reverse V-V curve, such as shown in FIG. 4, which is obtained by seeking a minimum "fit error" for an absolute error of the T value compared to an ideal curve after curve fitting. The nine points of the V-V curve so produced are then arithmetically combined with the measured γ - curve resulting in a substantially straight line correction curve such as shown in FIG. 5. The values of the straight line curve are then used to produce a set of corrected voltage values for the light transmittance at different positions or viewing angles of the display. These corrected voltage values may be stored in memory, such as in a ROM table, and when applied as input voltages to the display will result in the creation of a uniform appearance on the LCD screen to a viewer.

Thus, the method of the invention basically involves the steps of:

(1.) Evaluating the measured γ - curve data supplied by the manufacturer relating to an LCD panel to have its γ - curve corrected;

(2.) Select a number of points, preferably nine, which may be different from the measured data but calculated therefrom, to produce an inverse γ - curve that when combined with the measured γ - curve results in a substantially straight line correction curve;

(3.) Calculating the error between the substantially straight line correction curve and an ideal V-T curve.

(4.) Repeating steps 2 and 3, if necessary, until the error is acceptable.

(5.) Storing voltage values at the selected points, i.e., nine points in the preferred embodiment, and (6.) Applying the corrected γ - curve values from memory to input voltages that control the light transmittance of the scan lines of the LCD panel to produce a display substantially corrected for errors in viewing angle so that it has a uniform appearance to a viewer.

Figure 6:
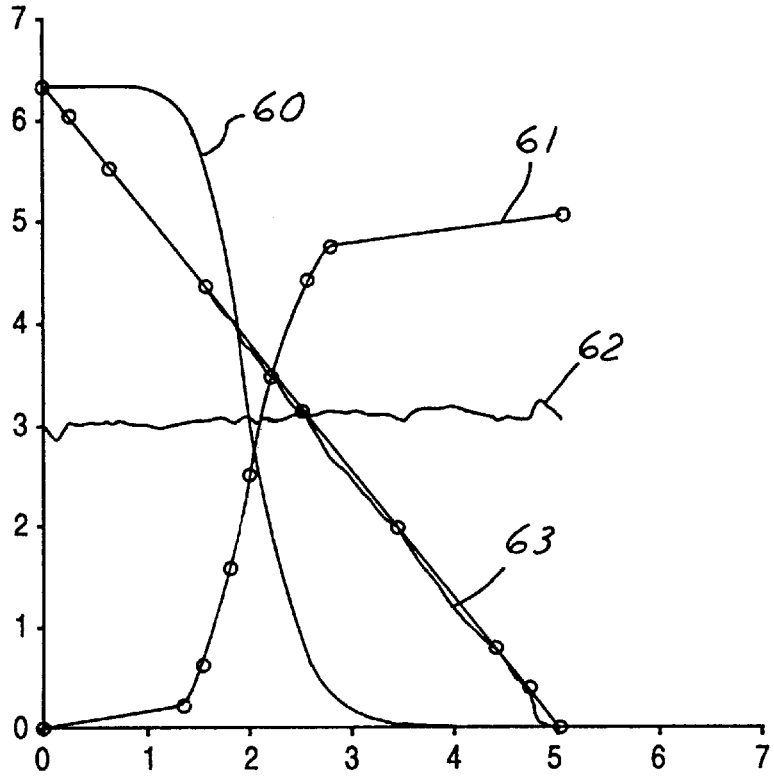
FIG. 6 shows an example of a comparison of the curves used in accomplishing the method of the invention.

FIG. 6 shows an example of a comparison of the curves used in accomplishing the method of the invention. The curves include the measured γ - curve 60, the inverse γ - curve or V-V curve 61, the error after fitting curve 62, and the straight line corrected V-T curve 63. It should be noted that the data points in the error after fitting curve 62 were arbitrarily increased by 3 for illustration purpose.

Figure 7:
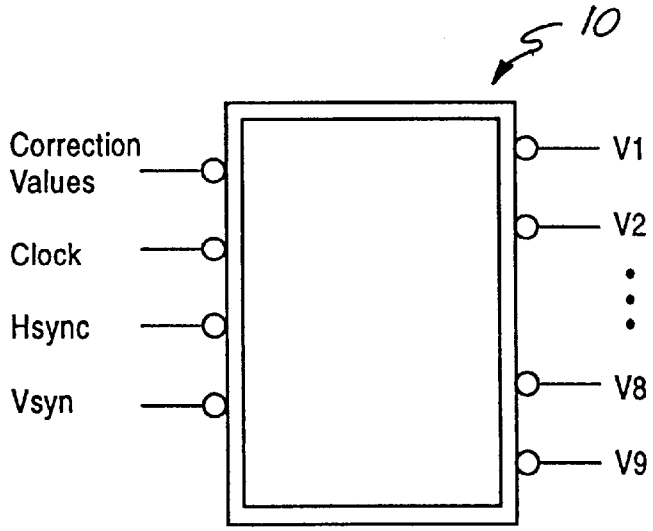
FIG. 7 illustrates an application specific integrated circuit (ASIC) element with inputs and outputs for use in dynamic γ - curve correction in accordance with the present invention.

A suitable means or system for carrying out the foregoing method is shown in FIG. 7 and utilizes an application specific integrated circuit (ASIC) element 10 with inputs and outputs for use in dynamic γ - curve correction in accordance with the present invention. The ASIC 10 is in the LCD scan control circuit and may control a display composed, e.g., of 640 by 480 lines. The ASIC 10 accordingly has a clock signal input, a horizontal synchronization (Hsync) signal input, and a vertical synchronization (Vsync) signal input. It may also have an input for receiving sets of γ - curve correction value signals or contain memories for storing the sets of corrected voltage values for the scan lines of the LCD. The horizontal scan and vertical scan signals are used as references for "dynamically" controlling the application of the sets of corrected voltage values to the sets of γ - curve correction voltage signals supplied to each of the 480 horizontal scan lines of the display. The correction voltage signals are output on a plurality of output lines V1–V9 to the display.

Figure 8:
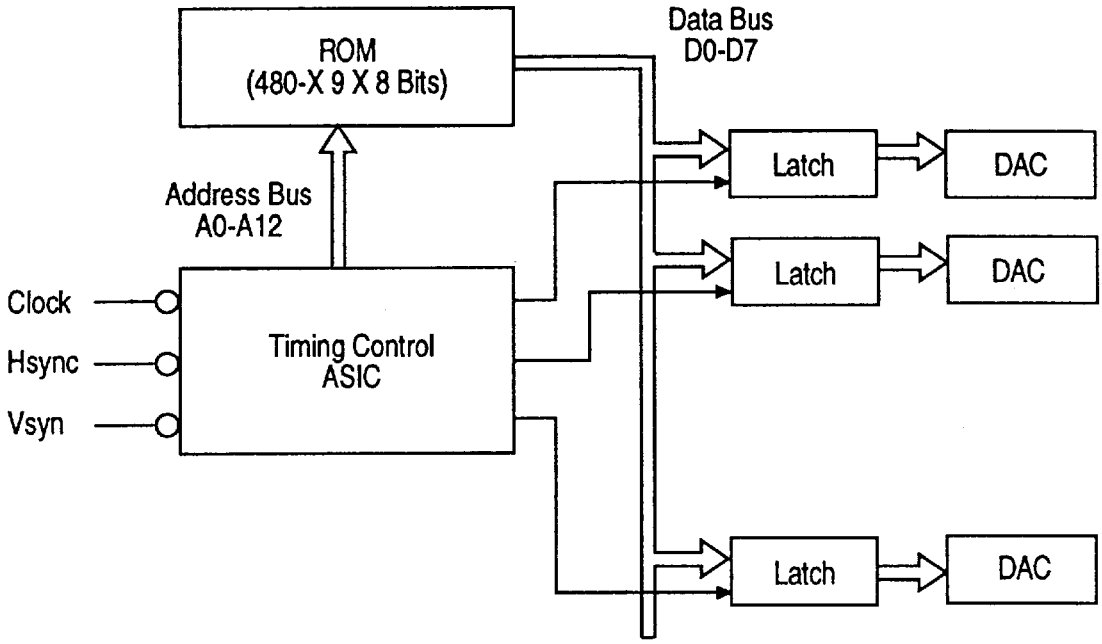
FIG. 8 is a block diagram illustrating a combination of circuit components of a first high speed memory embodiment for implementing the present invention.

FIG. 8 illustrates one particular combination of circuit components of a high speed memory embodiment for implementing the present invention. In this case the sets of corrected voltage values for the scan lines of the LCD are stored in separate high speed memories 22 and the ASIC 20 is used for timing control with clock, Hsync, and Vsynch inputs. ASIC 20 outputs the timing control signals on an address bus 21 to the set of high speed memories 22. The memories 22 may be implemented with a plurality of read-only memories (ROMs), e.g., 480×9×8 bits, where the 9 represents the nine points of the inverse γ - curve. The sets of corrected voltage values for the horizontal scan lines are stored in ROM tables in the high speed memories 22 and are output, in response to the timing signals from the ASIC 20, on a data bus 25 to a set of nine data latches 24. The ASIC 20 also provides a set of latch enable signals 23 to the set of data latches 24. The input signals from the memories 22 to the latches 24 are the corrected voltage values that result in the output of corrected voltage signals from the latches 24. The nine data latches 24 provide corrected voltage outputs, through a set of digital to analog converters (DACs) 26 to the output lines V1–V9 connected to the LCD. The display is thus supplied with γ - curve correction voltages for the different viewing angles for the horizontal scan lines of the LCD.

Figure 9:
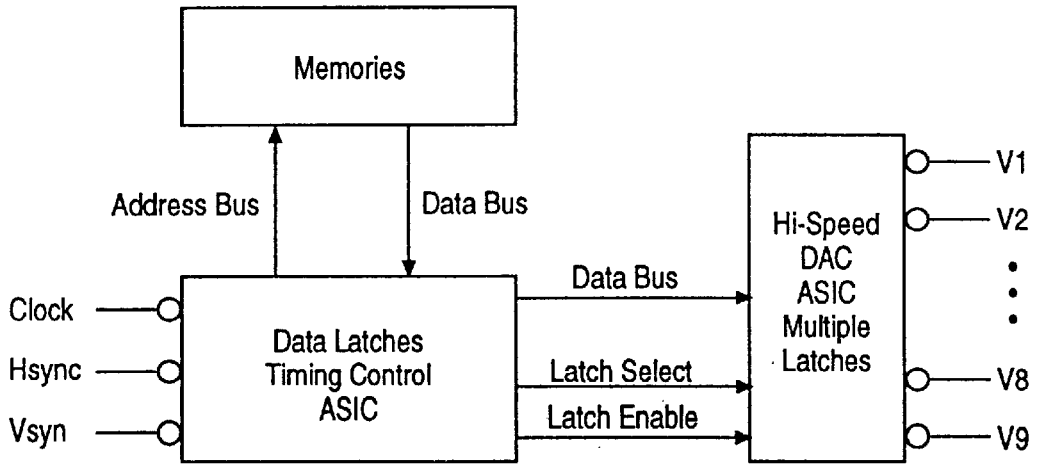
FIG. 9 is a block diagram illustrating a combination of circuit components of a second low speed memory embodiment for implementing the present invention.

FIG. 9 is an alternative or second embodiment for implementing the present invention utilizing a combination of circuit components including a set of low speed memories 32, rather than the high speed memories of FIG. 8, so that the ASIC 30 also contains the data latches along with the timing control circuitry. As a result, the ASIC 30 sends timing signals on an address bus 31 to the low speed memories 32 which return the corrected voltage values stored therein on data bus 33 to the ASIC 30. The ASIC 30 in turn outputs the corrected voltage value signals on data bus 35 to an output component 36 which may consist of a set of high speed DACs with multiple latches. The multiple latches are controlled by latch select and latch enable signals on respective lines 37 and 38 from the ASIC 30 and the DACs provide the corrected voltage signals in analog form as outputs over the output lines V1–V9 to the LCD.

It will therefore be seen that an improved method and means have been described for correcting the γ - curve of an LCD and using the curve to correct the applied voltage values at different positions or viewing angles on the face of the display to correct the light transmission at different angles and give a uniform appearance to the display.

While the present invention has been described in an illustrative manner, it should be understood that the terminology used is intended to be in a nature of words of description rather than of limitation.

Furthermore, while the present invention has been described in terms of a preferred embodiments, it is to be appreciated that those skilled in the art will readily apply these teachings to other possible variations of the invention.

The embodiment of the invention in which an exclusive property or privilege is claimed are defined in the following claims:

What is claimed is:

1. A system for dynamically correcting the γ - curve of a liquid crystal display (LCD), comprising:

means for obtaining a measured γ - curve for an LCD to be corrected;

means for determining an inverse γ - curve based on the measured γ - curve and producing a straight line correction curve for the different viewing angles of the horizontal scan lines of said LCD;

means for producing sets of corrected voltage values in accordance with said straight line correction curve;

means for storing said sets of corrected voltage values for the horizontal scan lines of said LCD;

timing means for producing timed horizontal scan and vertical scan signals to control said LCD;

means, responsive to said horizontal scan and vertical scan signals of said LCD as references, for outputting said sets of corrected voltage values in said storing means to dynamically produce sets of corrected voltage signals in accordance with said corrected voltage values; and means for applying said sets of corrected voltage signals to said LCD to dynamically correct the γ - curve of said LCD.

2. A system according to claim 1, wherein said storing means comprises a digital memory and said applying means comprises:

means for converting said corrected voltage signals from digital signals to analog signals and applying said analog signals to said LCD.

3. A system according to claim 2, wherein said applying means further comprises:

latch means, responsive to said corrected voltage signals, for providing signals indicative of said digital signals to said analog to digital converting means.

4. A system according to claim 3, wherein said digital memory comprises a plurality of high speed memories, and said timing means comprises means for providing latch enable signals to said latch means.

5. A system according to claim 3, wherein said digital memory comprises a plurality of low speed memories, and said timing means comprises an ASIC including:

data latches;

an address bus output to said low speed memories;

a data bus input from said low speed memories;

an output data bus to said latch means;

a latch enable output to said latch means; and a latch select output to said latch means.

6. A system according to claim 1, wherein said timing means is incorporated in an ASIC.

7. A system according to claim 1, wherein said timing means and said storing means for storing said sets of corrected voltage values are incorporated in an ASIC.

8. A method for dynamically correcting the γ - curve of a liquid crystal display (LCD), comprising the steps of:

obtaining a measured γ - curve for an LCD to be corrected;

determining an inverse γ - curve based on the measured γ - curve and producing a straight line correction curve for the different viewing angles of the horizontal scan lines of said LCD;

producing sets of corrected voltage values in accordance with said straight line correction curve;

storing said sets of corrected voltage values for the horizontal scan lines of said LCD in memory;

producing timed horizontal scan and vertical scan signals to control said LCD;

in response to said horizontal scan and vertical scan signals of said LCD as references, using said sets of corrected voltage values in said memory to dynamically produce sets of corrected voltage signals in accordance with said correction voltage values; and applying said corrected voltage signals to said LCD to dynamically correct the γ - curve of said LCD.

9. The method according to claim 8, wherein said sets of corrected voltage values are stored digitally and comprising the further step of converting said sets of corrected voltage signals from digital to analog signals and applying said analog signals to said LCD.

10. A method for dynamically correcting the γ - curve of a liquid crystal display (LCD), comprising the steps of:

obtaining measured γ - curve data for an LCD to have its γ - curve corrected;

selecting a number of points using said measured γ - curve data and calculating an inverse γ - curve that when multiplied with the measured γ - curve data results in a substantially straight line correction γ - curve;

storing the straight line correction γ - curve values; and applying the stored corrected γ - curve values to input voltages that control the light transmittance of the scan lines of the LCD and produce an LCD substantially corrected for errors in viewing angle whereby said LCD has a uniform appearance to a viewer.

11. The method according to claim 10 further comprising the steps of:

producing timed horizontal scan and vertical scan signals to control said LCD; and using said timed horizontal scan and vertical scan signals to control the timing of said applying step.

12. The method according to claim 10, wherein said straight line correction γ - curve values are stored digitally, said input voltages are digital, and comprising the further step of converting said input voltages from digital to analog signals and applying said analog signals to said LCD.

* * * * *